US012799554B2

(12) United States Patent
Mohanty et al.

(10) Patent No.: US 12,799,554 B2
(45) Date of Patent: Nov. 17, 2026

(54) METHOD FOR PRODUCING A HIGH STRENGTH STEEL SHEET HAVING IMPROVED STRENGTH AND FORMABILITY AND OBTAINED SHEET

(71) Applicant: ArcelorMittal, Luxembourg (LU)

(72) Inventors: Rashmi Ranjan Mohanty, East Chicago, IN (US); Hyun Jo Jun, East Chicago, IN (US); Dongwei Fan, East Chicago, IN (US); Pavan K. C. Venkatasurya, East Chicago, IN (US)

(73) Assignee: ArcelorMittal, Luxembourg (LU)

( * ) Notice: Subject to any disclaimer, the term of this patent is extended or adjusted under 35 U.S.C. 154(b) by 156 days.

(21) Appl. No.: 17/835,347

(22) Filed: Jun. 8, 2022

(65) Prior Publication Data

US 2022/0298598 A1 Sep. 22, 2022

Related U.S. Application Data

(62) Division of application No. 15/322,712, filed as application No. PCT/IB2015/055037 on Jul. 3, 2015, now Pat. No. 11,555,226.

(30) Foreign Application Priority Data

Jul. 3, 2014 (WO) ..... PCT/IB2014/002296

(51) Int. Cl.
*C22C 38/06* (2006.01)
*C21D 1/18* (2006.01)
(Continued)

(52) U.S. Cl.
CPC ..... *C21D 9/46* (2013.01); *C21D 1/18* (2013.01); *C21D 1/19* (2013.01); *C21D 6/005* (2013.01);
(Continued)

(58) Field of Classification Search
CPC ... C21D 9/46; C21D 1/18; C21D 1/19; C21D 6/005; C21D 6/008; C21D 8/0447;
(Continued)

(56) References Cited

U.S. PATENT DOCUMENTS 4,159,218 A 6/1979 Chatfield
6,114,656 A 9/2000 Fairchild
(Continued)

FOREIGN PATENT DOCUMENTS

CN 101225499 A 7/2008
CN 101351570 A 1/2009
(Continued)

OTHER PUBLICATIONS

Machine Translation of JP-2010126770-A (Year: 2010).*
(Continued)

*Primary Examiner* — John A Hevey
(74) *Attorney, Agent, or Firm* — Davidson Kappel LLC

(57) ABSTRACT

A steel sheet made of a steel having a chemical composition containing in weight %: 0.13%≤C≤0.22%, 1.2%≤Si≤1.8%, 1.8%≤Mn≤2.2%, 0.10%≤Mo≤0.20%, Nb≤0.05%, Ti≤0.05%, Al≤0.5%, a remainder being Fe and unavoidable impurities. The steel sheet has a yield strength of at least 850 MPa, a tensile strength of at least 1180 MPa, a total elongation of at least 13% and a hole expansion ratio HER of at least 30%.

25 Claims, 1 Drawing Sheet

(51) Int. Cl.

| | |
|---|---|
| ***C21D 1/19*** | (2006.01) |
| ***C21D 6/00*** | (2006.01) |
| ***C21D 8/04*** | (2026.01) |
| ***C21D 9/46*** | (2006.01) |
| ***C21D 9/48*** | (2006.01) |
| ***C22C 38/02*** | (2006.01) |
| ***C22C 38/04*** | (2006.01) |
| ***C22C 38/12*** | (2006.01) |
| ***C22C 38/14*** | (2006.01) |

(52) U.S. Cl.

CPC ..... *C21D 6/008* (2013.01); *C21D 8/0447* (2013.01); *C21D 9/48* (2013.01); *C22C 38/02* (2013.01); *C22C 38/04* (2013.01); *C22C 38/06* (2013.01); *C22C 38/12* (2013.01); *C22C 38/14* (2013.01); *C21D 8/0426* (2013.01); *C21D 8/0436* (2013.01); *C21D 2211/001* (2013.01); *C21D 2211/002* (2013.01); *C21D 2211/008* (2013.01)

(58) Field of Classification Search

CPC ..... C21D 9/48; C21D 8/0426; C21D 8/0436; C21D 2211/001; C21D 2211/002; C21D 2211/008; C21D 1/20; C21D 8/0226; C21D 8/0236; C21D 8/0247; C21D 8/0242; C22C 38/02; C22C 38/04; C22C 38/06; C22C 38/12; C22C 38/14

See application file for complete search history.

(56) References Cited

U.S. PATENT DOCUMENTS

| | | | | |
|---|---|---|---|---|
| 6,264,760 | B1 | 7/2001 | Tamehiro et al. | |
| 8,697,252 | B2 | 4/2014 | Irie et al. | |
| 9,011,614 | B2 | 4/2015 | Nakagaito et al. | |
| 9,121,087 | B2 | 9/2015 | Matsuda et al. | |
| 9,290,834 | B2 | 3/2016 | Hasegawa et al. | |
| 9,856,548 | B2 | 1/2018 | Allain et al. | |
| 10,190,186 | B2 | 1/2019 | Hasegawa et al. | |
| 2003/0111145 | A1 | 6/2003 | Kusinski | |
| 2006/0011274 | A1 | 1/2006 | Speer et al. | |
| 2008/0251161 | A1 | 10/2008 | Kashima et al. | |
| 2008/0271824 | A1* | 11/2008 | Fujino | C21D 1/25 148/328 |
| 2009/0065103 | A1 | 3/2009 | Sippola | |
| 2009/0238713 | A1 | 9/2009 | Kinugasa et al. | |
| 2009/0277547 | A1* | 11/2009 | Saito | C22C 38/12 420/104 |
| 2010/0221138 | A1 | 9/2010 | Nakaya et al. | |
| 2010/0221573 | A1 | 9/2010 | Drillet et al. | |
| 2010/0263773 | A1 | 10/2010 | Cho | |
| 2010/0273024 | A1 | 10/2010 | Bocharova et al. | |
| 2011/0036465 | A1* | 2/2011 | Kawasaki | C21D 9/46 148/333 |
| 2011/0146852 | A1 | 6/2011 | Matsuda et al. | |
| 2011/0198002 | A1* | 8/2011 | Nakagaito | C21D 1/25 148/333 |
| 2011/0220252 | A1 | 9/2011 | Hammer et al. | |
| 2012/0175028 | A1* | 7/2012 | Matsuda | C22C 38/38 148/333 |
| 2013/0160904 | A1* | 6/2013 | Saito | B32B 15/013 148/333 |
| 2013/0276940 | A1 | 10/2013 | Nakajima et al. | |
| 2013/0295402 | A1 | 11/2013 | Oh et al. | |
| 2014/0170439 | A1 | 6/2014 | Allain et al. | |
| 2014/0234655 | A1 | 8/2014 | Takashima et al. | |
| 2014/0322559 | A1 | 10/2014 | Becker et al. | |
| 2015/0101712 | A1 | 4/2015 | Futamura et al. | |
| 2015/0203946 | A1* | 7/2015 | Hammer | C22C 38/42 148/602 |
| 2015/0203947 | A1 | 7/2015 | Hasegawa et al. | |
| 2015/0368742 | A1* | 12/2015 | Shibata | C21D 8/0226 148/320 |
| 2016/0160310 | A1* | 6/2016 | Hasegawa | C22C 38/12 148/537 |
| 2016/0355900 | A1 | 12/2016 | Gil Otin et al. | |
| 2017/0130290 | A1 | 5/2017 | Fan et al. | |
| 2017/0130292 | A1 | 5/2017 | Mohanty et al. | |
| 2017/0152579 | A1 | 6/2017 | Mohanty et al. | |
| 2023/0243007 | A1* | 8/2023 | Hoffmann | C23C 2/06 148/533 |

FOREIGN PATENT DOCUMENTS

| | | | | |
|---|---|---|---|---|
| CN | 101437975 | A | | 5/2009 |
| CN | 101802233 | A | | 8/2010 |
| CN | 101802237 | A | | 8/2010 |
| EP | 1707645 | A1 | | 10/2006 |
| EP | 1724371 | A1 | | 11/2006 |
| EP | 2202327 | A1 | | 6/2010 |
| EP | 2267176 | A1 | | 12/2010 |
| EP | 2325346 | A1 | | 5/2011 |
| EP | 2436794 | A1 | | 4/2012 |
| EP | 2524970 | A1 | | 11/2012 |
| EP | 2881481 | A1 | | 6/2015 |
| GB | 2439069 | A | | 12/2007 |
| JP | 2003013177 | A | | 1/2003 |
| JP | 2006083403 | A | | 3/2006 |
| JP | 2007197819 | A | | 8/2007 |
| JP | 2008038247 | A | | 2/2008 |
| JP | 2009173959 | A | | 8/2009 |
| JP | 5315956 | B2 | | 6/2010 |
| JP | 2010126770 | A | * | 6/2010 |
| JP | 2012021225 | A | | 2/2012 |
| JP | 2012031462 | A | | 2/2012 |
| JP | 2012229466 | A | | 11/2012 |
| JP | 2012240095 | A | | 12/2012 |
| JP | 2013040383 | A | | 2/2013 |
| JP | 2013227653 | A | | 11/2013 |
| JP | 2013237923 | A | | 11/2013 |
| JP | 2014019928 | A | | 2/2014 |
| JP | 2014034716 | A | * | 2/2014 |
| RU | 2474623 | C1 | | 2/2011 |
| RU | 2518852 | A | | 6/2014 |
| WO | WO2004022794 | A1 | | 3/2004 |
| WO | WO2012120020 | A1 | | 9/2012 |
| WO | WO2013146087 | A1 | | 10/2013 |
| WO | WO2014020640 | A1 | | 2/2014 |

OTHER PUBLICATIONS

Hance, Brandon M. "Practical Application of the Hole Expansion Test." SAE International Journal of Engines, vol. 10, No. 2, 2017, pp. 247-257 (Year: 2017).*

Machine Translation of JP-2014034716-A (Year: 2014).*

Morsdorf, L., et al., "Multiple Mechanisms of Lath Martensite Plasticity." Acta Materialia, vol. 121, 2016, pp. 202-214 (Year: 2016).

Ji, Mo et al., "Effect of Grain Size Distribution on Recrystallisation Kinetics in an Fe—30Ni Model Alloy." Metals, vol. 9, No. 3, 2019, p. 369 (Year: 2019).

Garcia-Mateo et al., "On Measurement of Carbon Content in Retained Austenite in a Nanostructured Bainitic Steel," J Mater Sci, vol. 47, pp. 1004-1010 (2012).

Scott et al., "A Study of the Carbon Distribution in Retained Austenite," Scripta Materialia, vol. 56, pp. 489-492 (2007).

Bagliani et al., "Microstructure, Tensile and Toughness Properties after Quenching and Partitioning Treatments of a Medium-Carbon Steel." Materials Science and Engineering: A, vol. 559, 2013, pp. 486-495.

L. Wang et al., "Quenching and Partitioning Steel Heat Treatment," Metallogr. Microstruct. Anal. (2013), 2, pp. 268-281.

J. G. Speer et al., "Progress in the Global Development of the Quenching and Partitioning Process," Jpn. Soc. Heat. Treat. (Special Issue: Proceedings of the 17th IFHTSE Congress) 2008, 49, pp. 415-422.

(56) References Cited

OTHER PUBLICATIONS

E. De Moor, "Assessment of Quenching and Partitioning as a Fundamentally New Way of Producing Advanced High Strength Martensitic Steel Grades with Improved Ductility", Doctoral Thesis, University of Ghent, Jan. 2009.

K. W. Andrews, "Empirical Formulea for the calculation of some transformation temperatures," Journal of The Iron and Steel Institute, Jul. 1965, pp. 721-727.

Zhang Ke et al., "Ultrahigh strength-ductility steel treated by a novel quenching-partitioning-tempering process," Materials Science and Engineering: A, Elsevier, Amsterdam, NL, vol. 619, Oct. 5, 2014 (Oct. 5, 2014), pp. 205-211, XP029093356, ISSN: 0921 5093, DOI: 10.1016/J.MSEA.2014.09.100.

Augusta Martinelli Miranda et al., "Monitoring of less common residual elements in scrap feeds for EAF Steelmaking," Ironmaking & Steelmaking: Processes, Products and Applications, vol. 46, No. 7, Aug. 9, 2019 (Aug. 9, 2019), pp. 598-608, XP055752627, United Kingdom ISSN: 0301 9233, DOI: 10.1080/03019233.2019.1601851.

Shima Pashangeh et al., "Detection and Estimation of Retained Austenite in a High Strength Si-Bearing Bainite-Martensite-Retained Austenite Micro-Composite Steel after Quenching and Bainitic Holding (Q&B)," Metals, vol. 9, No. 5, Jan. 1, 2019 (Jan. 1, 2019), p. 492, XP055743883,CH ISSN: 2075 4701, DOI: 10.3390/met9050492.

Magner et al., A Historical review of retained austenite and its measurement by X-Ray diffraction, Advances In X Ray Analysis, vol. 45 : Proceedings of the 50th Annual Conference on Applications of X-Ray Analysis, (Denver X-Ray Conference), Jul. 30-Aug. 3, 2001, Steamboat Springs, Colorado, U.S.A., vol. 45, Jan. 1, 2002 (Jan. 1, 2002), Aug. 3, 2001 (Aug. 3, 2001), pp. 92-97, XP055743907, US.

Santofimia, M.J., et al."Microstructural Evolution of a Low-Carbon Steel during Application of Quenching and Partitioning Heat Treatments after Partial Austenitization" Metallurgical and Materials Transactions A, vol. 40, No. 1, 2008, pp. 46-57 (Year 2008).

Ning Zhong et al., "Microstructural Evolution of a Medium Carbon Advanced High Strength Steel Heat-Treated by Quenching-Partitioning Process", Aug. 16, 2013, John Wiley & Sons, Inc., Hoboken, NJ, USA, XP055166044, ISBN: 978-0-47-094309-0, pp. 885-889.

De Moore E et al., "Quench and Partitioning Response of a Mo-alloyed CMnSi Steel", New Developments on Metallurgy and Applications of High Strength Steels: Buenos Aires 2008; International Conference, May 28-28, Buenos Aires, Argentina, vol. 2, May 26, 2008, pp. 721-730.

Edmonds D V et al: "Quenching and partitioning martensite—A novel steel heat treatment", Material Science and Engineering A: Structural Materials: Properties, Microstructure & Processing, Lausanne, CH, vol. 438-440, Nov. 25, 2006, pp. 25-34.

Thomas G et al: "Alloy design for fundamental study of quenched and partitioned steels", Materials Science Technology Conferance & Exhibition, Colombus, OH, United States, Oct. 16, 2011, pp. 552-567.

* cited by examiner

METHOD FOR PRODUCING A HIGH STRENGTH STEEL SHEET HAVING IMPROVED STRENGTH AND FORMABILITY AND OBTAINED SHEET

This is a divisional of U.S. application Ser. No. 15/322,712 which has a filing date of Dec. 28, 2016 and which is a national stage of PCT/IB2015/055037 filed Jul. 3, 2015 which claims priority to PCT/IB2014/002296 filed Jul. 3, 2014, the entire disclosures of which are hereby incorporated by reference herein.

The present disclosure relates to a method for producing a high strength steel sheet having improved strength, ductility and formability and to the sheets obtained with the method.

BACKGROUND

To manufacture various equipment such as parts of body structural members and body panels for automotive vehicles, it is usual to use sheets made of DP (dual phase) steels or TRIP (transformation induced plasticity) steels.

For example, such steels which include a martensitic structure and/or some retained austenite and which contains about 0.2% of C, about 2% of Mn, about 1.7% of Si have a yield strength of about 750 MPa, a tensile strength of about 980 MPa, a total elongation of more than 8%. These sheets are produced on continuous annealing line by quenching from an annealing temperature higher than $Ac_3$ transformation point, down to a quench temperature lower than Ms transformation point followed by heating to an overaging temperature above the Ms point and maintaining the sheet at the temperature for a given time. Then the sheet is cooled down to the room temperature.

SUMMARY

Due to the wish to reduce the weight of the automotive in order to improve their fuel efficiency in view of the global environmental conservation it is desirable to have sheets having improved yield and tensile strength. But such sheets must also have a good ductility and a good formability and more specifically a good stretch flangeability.

In this respect, it is desirable to have sheets having a yield strength YS of at least 850 MPa, a tensile strength TS of about 1180 MPa, a total elongation of at least 13% or preferably at least 14% and a hole expansion ratio HER according to the ISO standard 16630:2009 of more than 30% or even 50%. Regarding the hole expansion ratio it must be emphasized that, due to differences in the methods of measure, the values of hole expansion ration HER according to the ISO standard are very different and not comparable to the values of the hole expansion ratio λ according to the JFS T 1001 (Japan Iron and Steel Federation standard).

Therefore, a purpose of the present disclosure is to provide such sheet and a method to produce it.

For this purpose, the present disclosure relates to a method for producing a high strength steel sheet having an improved strength and an improved formability, the sheet having a yield strength YS of at least 850 MPa, a tensile strength TS of at least 1180 MPa, a total elongation of at least 13% and a hole expansion ratio HER of at least 30%, by heat treating a steel sheet whose chemical composition of the steel contains, in weight %:

0.13%≤C≤0.22%
1.2%≤Si≤1.8%
1.8%≤Mn≤2.2%

0.10%≤Mo≤0.20%
Nb≤0.05%
Ti≤0.05%
Al≤0.5% the remainder being Fe and unavoidable impurities. The sheet is annealed at an annealing temperature TA higher than 865° C. but less than 1000° C. for a time of more than 30 s. Then, the sheet is quenched by cooling down to a quenching temperature QT between 275° C. and 375° C., at a cooling speed of at least 30° C./s in order to have, just after quenching, a structure consisting of austenite and at least 50% of martensite, the austenite content being such that the final structure i.e. after treatment and cooling to the room temperature, can contain between 3 and 15% of residual austenite and between 85% and 97% of the sum of martensite and bainite without ferrite. Then, the sheet is heated up to a partitioning temperature PT between 370° C. and 470° C. and maintained at this temperature for a partitioning time Pt between 50 s and 150 s. Then the sheet is cooled down to the room temperature.

Preferably, the chemical composition of the steel is such that Al≤0.05%.

Preferably, the quenching temperature QT is comprised between 310° C. and 375° C., in particular between 310 and 340° C.

Preferably, the method further comprises, after the sheet is quenched to the quenching temperature QT and before heating the sheet up to the partitioning temperature PT, a step of holding the sheet at the quenching temperature for a holding time comprised between 2 s and 8 s, preferably between 3 s and 7 s.

The present disclosure relates also to a steel sheet whose chemical composition contains in weight %:

0.13%≤C≤0.22%
1.2%≤Si≤1.8%
1.8%≤Mn≤2.2%
0.10%≤Mo≤0.20%
Nb≤0.05%
Ti<0.05%
Al≤0.5% the remainder being Fe and unavoidable impurities, the sheet having a yield strength of at least 850 MPa, a tensile strength of at least 1180 MPa, a total elongation of at least 13% and a hole expansion ratio HER of at least 30%.

The structure of the steel comprises between 3 and 15% of residual austenite and between 85% and 97% of the sum of martensite and bainite, without ferrite.

Preferably, the chemical composition of the steel is such that Al<0.05%.

Preferably, the average grain size of the retained austenite is of 5 μm or less.

The average size of the grains or blocks of martensite and bainite is preferably of 10 μm or less.

BRIEF SUMMARY OF THE DRAWINGS

The present disclosure will now be described in details but without introducing limitations and illustrated by FIGS. 1 and 2 which represents SEM micrograph of two examples of the present disclosure.

DETAILED DESCRIPTION

Figure 1:
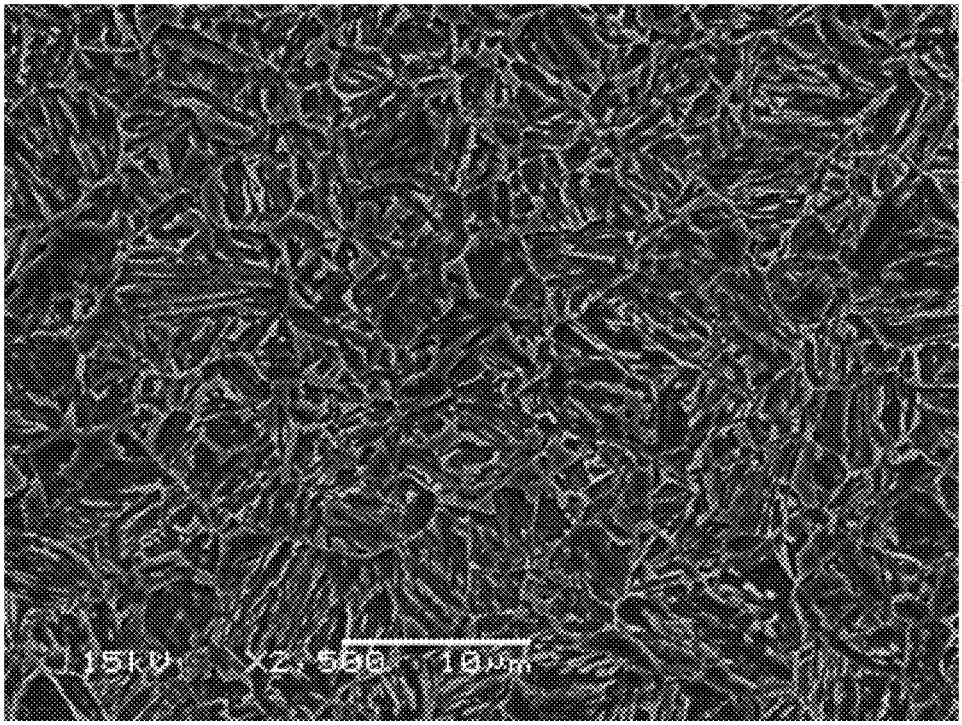

According to the present disclosure, the sheet is obtained by hot rolling and optionally cold rolling of a semi product made of a steel which chemical composition contains, in weight %:

0.13% to 0.22%, and preferably more than 0.16%, preferably less than 0.20% of carbon for ensuring a satisfactory strength and improving the stability of the retained austenite which is necessary to obtain a sufficient elongation. If carbon content is too high, the hot rolled sheet is too hard to cold roll and the weldability is insufficient.

1.2% to 1.8% preferably more than 1.3% and less than 1.6% of silicon in order to stabilize the austenite, to provide a solid solution strengthening and to delay the formation of carbides during overaging.

1.8% to 2.2% and preferably more than 1.9% and preferably less than 2.1% of manganese to have a sufficient hardenability in order to obtain a structure containing at least 65% of martensite, tensile strength of more than 1150 MPa and to avoid having segregation issues which are detrimental for the ductility.

0.10% to 0.20% of molybdenum to increase the hardenability and to stabilize the retained austenite in order to delay the decomposition of austenite such that there is no decomposition of the austenite during overaging according to the present disclosure, up to 0.5% of aluminum which is usually added to liquid steel for the purpose of deoxidation. If the content of Al is above 0.5%, the austenitizing temperature will be too high to reach and the steel will become industrially difficult to process. Preferably, the Al content is limited to 0.05%.

Nb content is limited to 0.05% because above such value large precipitates will form and formability will decrease, making the 13% of total elongation more difficult to reach.

Ti content is limited to 0.05% because above such value large precipitates will form and formability will decrease, making the 13% of total elongation more difficult to reach.

The remainder is iron and residual elements resulting from the steelmaking. In this respect, Ni, Cr, Cu, V, B, S, P and N at least are considered as residual elements which are unavoidable impurities. Therefore, their contents are less than 0.05% for Ni, 0.10% for Cr, 0.03% for Cu, 0.007% for V, 0.0010% for B, 0.005% for S, 0.02% for P and 0.010% for N.

The sheet is prepared by hot rolling and optionally cold rolling according to the methods known by those who are skilled in the art.

After rolling the sheets are pickled or cleaned then heat treated.

The heat treatment which is made preferably on a continuous annealing line comprises the steps of:

annealing the sheet at an annealing temperature TA higher than the $Ac_3$ transformation point of the steel, and preferably higher than $Ac_3$+15° C. i.e. higher than 865° C. for the steel according to the present disclosure, in order to be sure that the structure is completely austenitic, but less than 1000° C. in order not to coarsen too much the austenitic grains. The sheet is maintained at the annealing temperature i.e. maintained between TA−5° C. and TA+10° C., for a time sufficient to homogenize the chemical composition. The maintaining time is preferably of more than 30 seconds but does not need to be of more than 300 seconds quenching the sheet by cooling down to a quenching temperature QT lower than the Ms transformation point at a cooling rate enough to avoid ferrite and bainite formation. The quenching temperature is between 275° C. and 375° C. and preferably between 290° C. and 360° C. in order to have, just after quenching, a structure consisting of austenite and at least 50% of martensite, the austenite content being such that the final structure i.e. after treatment and cooling to the room temperature, can contain between 3 and 15% of residual austenite and between 85% and 97% of the sum of martensite and bainite without ferrite. Preferably, the quenching temperature is above 300° C., in particular comprised between 310° C. and 375° C., for example between 310° C. and 340° C. A cooling rate higher than 30° C./s is required to avoid the ferrite formation during cooling from the annealing temperature TA.

reheating the sheet up to a partitioning temperature PT between 370° C. and 470° C. and preferably between 390° C. and 460° C. Above 470° C., the mechanical properties of the steel targeted, in particular a tensile strength of at least 1180 MPa and a total elongation of at least 13%, are not obtained. The reheating rate can be high when the reheating is made by induction heater, but that reheating rate in the range of 5-20° C./s had no apparent effect on the final properties of the sheet. The heating rate is thus preferably comprised between 5° C./s and 20° C./s. For example, the reheating rate is of at least 10° C./s. Preferably, between the quenching step and the step of reheating the sheet to the partitioning temperature PT, the sheet is held at the quenching temperature for a holding time comprised between 2 s and 8 s, preferably between 3 s and 7 s.

maintaining the sheet at the partitioning temperature PT for a time between 50 s and 150 s. Maintaining the sheet at the partitioning temperature means that during partitioning the temperature of the sheet remains between PT−10° C. and PT+10° C.

cooling the sheet down to the room temperature.

With such treatment, sheets having a yield strength YS of at least 850 MPa, a tensile strength of at least 1180 MPa, a total elongation of at least 13% and a hole expansion ratio HER according to the ISO standard 16630:2009 of at least 30%, or even 50%, can be obtained.

This treatment allows obtaining a final structure i.e. after partitioning and cooling to the room temperature, containing between 3 and 15% of residual austenite and between 85 and 97% of the sum of martensite and bainite without ferrite.

Moreover, the average austenitic grain size is preferably of 5 μm or less, and the average size of the blocks of bainite or martensite is preferably of 10 μm or less.

As an example a sheet of 1.2 mm in thickness having the following composition:

C=0.18%, Si=1.55% Mn=2.02%, Nb=0.02%, Mo=0.15%, Al=0.05%, N=0.06%, the remainder being Fe and impurities, was manufactured by hot and cold rolling. The theoretical Ms transformation point of this steel is 386° C. and the $Ac_3$ point is 849° C.

Samples of the sheet were heat treated by annealing, quenching and partitioning, and the mechanical properties were measured. The sheets were held at the quenching temperature for about 3 s.

The conditions of treatment and the obtained properties are reported at table I.

TABLE I

| Sample | TA ° C. | QT ° C. | PT ° C. | Pt s | YS MPa | TS MPa | TE % | HER % | RA % | RA grain size μm | M + B % | M + B grain size μm |
|---|---|---|---|---|---|---|---|---|---|---|---|---|
| 1 | 900 | 350 | 450 | 99 | 978 | 1202 | 14 | 32 | 10.4 | ≤5 | 89.6 | ≤10 |
| 2 | 900 | 300 | 450 | 99 | 1185 | 1246 | 13.8 | 57 | 6.8 | ≤5 | 93.2 | ≤10 |
| 3 | 900 | 450 | 450 | 99 | 620 | 1129 | 15.5 | 20 | 8.9 | ≤5 | | ≤10 |
| 4 | 900 | 400 | 450 | 99 | 857 | 1185 | 12.2 | 29 | 8.7 | ≤5 | | ≤10 |
| 5 | 900 | 340 | 470 | 50 | 1025 | 1185 | 13.8 | 32 | 10.6 | | | |
| 6 | 900 | 275 | 500 | 100 | 998 | 1149 | 12.7 | 47 | 4.6 | | | |

In this table, TA is the annealing temperature, QT the quenching temperature, PT the partitioning temperature, Pt the partitioning time, YS the yield strength, TS the tensile strength, TE the total elongation, HER the hole expansion ratio according to the ISO standard, RA the proportion of retained austenite in the final structure, RA grain size is the average austenite grain size, M+B is the proportion of bainite and martensite in the final structure and M+B grain size is the average size of the grains or blocks of martensite and bainite.

Figure 2:
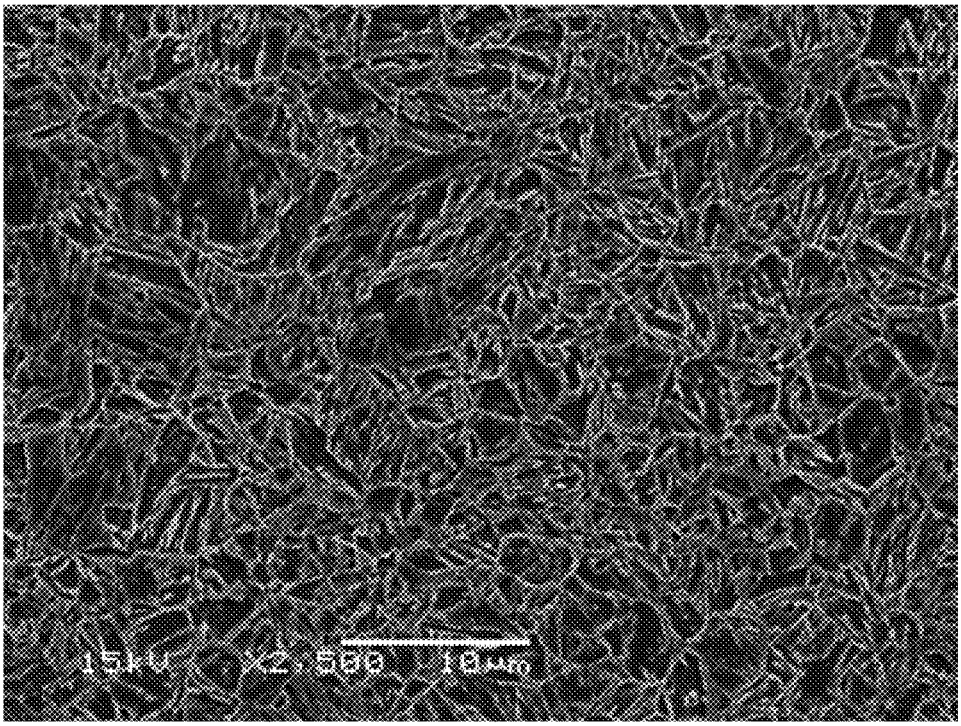

Example 1, whose structure is shown at FIG. 1 and which contains 10.4% of retained austenite and 89.6% of martensite and bainite, and example 2, whose structure is shown at FIG. 2 and which contains 6.8% of retained austenite and 93.2% of martensite and bainite, show that, with a quenching temperature of 300° C. or 350° C., a partitioning at a temperature of 450° C. with a partitioning time of 99 s the sheet has a yield strength higher than 850 MPa, a tensile strength higher than 1100 MPa, a total elongation of about 14% higher than 13% and a hole expansion ratio measured according to ISO standard 16630: 2009 higher than 30%. When the quenching temperature is 300° C. (+/−10° C.), the total elongation can be higher than 13% and the hole expansion ratio is very good: 57%, as shown in Example 2.

Examples 3 and 4 which are related to the prior art with a quenching temperature higher than Ms, i.e. the structure not being martensitic, show that it is not possible to reach simultaneously the targeted yield strength, total elongation and hole expansion ratio.

Example 5 further shows that with a quenching temperature of 340° C., a partitioning at 470° C. with a partitioning time of 50 s, the sheet has a yield strength higher than 850 MPa, a tensile strength higher than 1100 MPa, a total elongation of about 14% higher than 13% and a hole expansion ratio measured according to ISO standard 16630: 2009 higher than 30%.

Example 6 shows that when the partitioning temperature is too high, i.e. above 470° C., a tensile strength of at least 1180 MPa and a total elongation of at least 13% are not obtained.

What is claimed is:

1. A steel sheet made of a steel having a chemical composition containing in weight %:

0.13%≤C≤0.22%
1.2%≤Si≤1.8%
1.8%≤Mn≤2.2%
0.10%≤Mo≤0.20%
Nb≤0.05%
Ti<0.05%
Al≤0.5% a remainder being Fe and unavoidable impurities, wherein the steel sheet has a structure comprising, by volume, between 3% and 15% of residual austenite and between 85% and 97% of the sum of martensite and bainite, without ferrite, wherein the steel sheet has a yield strength of at least 978 MPa, a tensile strength of at least 1180 MPa, a total elongation of at least 13% and a hole expansion ratio HER according to the ISO standard 16630:2009 of at least 30%, the structure comprising, by volume, at most 50% martensite.

2. The steel sheet according to claim 1, wherein the martensite and the bainite consist of grains or blocks having an average size of 10 μm or less.

3. A steel sheet made of a steel having a chemical composition containing in weight %:

0.13%≤C≤0.22%
1.2%≤Si≤1.8%
1.8%≤Mn≤2.2%
0.10%≤Mo≤0.20%
Nb≤0.05%
Ti<0.05%
Al≤0.5% a remainder being Fe and unavoidable impurities, wherein the steel sheet has a structure comprising, by volume, between 3% and 15% of residual austenite and between 85% and 97% of the sum of martensite and bainite, without ferrite, wherein the steel sheet has a yield strength of at least 978 MPa, a tensile strength of at least 1180 MPa, a total elongation of at least 13% and a hole expansion ratio HER according to the ISO standard 16630:2009 of at least 30%.

4. The steel sheet according to claim 3, wherein the martensite and the bainite consist of grains or blocks having an average size of 10 μm or less.

5. The steel sheet according to claim 1, wherein the chemical composition of the steel satisfies Al≤0.05%.

6. The steel sheet according to claim 1, wherein the chemical composition of the steel satisfies 0.16%≤C≤0.22%.

7. The steel sheet according to claim 1, wherein the chemical composition of the steel satisfies 0.16%≤C≤0.20%.

8. The steel sheet according to claim 1, wherein the chemical composition of the steel satisfies 1.3%≤Si≤1.6%.

9. The steel sheet according to claim 1, wherein the chemical composition of the steel satisfies 1.9%≤Mn≤2.1%.

10. The steel sheet according to claim 1, wherein the total elongation is at least 14%.

11. The steel sheet according to claim 1, wherein the hole expansion ratio according to the ISO standard 16630:2009 is at least 50%.

12. The steel sheet according to claim 1, wherein the steel sheet has an average austenitic grain size of 5 μm or less for the residual austenite.

13. The steel sheet according to claim 3, wherein the structure comprises, by volume, at least 50% martensite.

14. The steel sheet according to claim 3, wherein the structure comprises, by volume, at least 65% martensite.

15. The steel sheet according to claim 3, wherein the chemical composition of the steel satisfies Al≤0.05%.

16. The steel sheet according to claim 3, wherein the chemical composition of the steel satisfies 0.16%≤C≤0.22%.

17. The steel sheet according to claim 3, wherein the chemical composition of the steel satisfies 0.16%≤C≤0.20%.

18. The steel sheet according to claim 3, wherein the chemical composition of the steel satisfies 1.3%≤Si≤1.6%.

19. The steel sheet according to claim 3, wherein the chemical composition of the steel satisfies 1.9%≤Mn≤2.1%.

20. The steel sheet according to claim 3, wherein the total elongation is at least 14%.

21. The steel sheet according to claim 3, wherein the hole expansion ratio according to the ISO standard 16630:2009 is at least 50%.

22. The steel sheet according to claim 3, wherein the steel sheet has an average austenitic grain size of 5 μm or less for the residual austenite.

23. The steel sheet according to claim 3, wherein the structure comprises, by volume, at most 65% martensite.

24. The steel sheet according to claim 3, wherein the structure comprises, by volume, at most 50% martensite.

25. The steel sheet according to claim 3, wherein the structure comprises, by volume, between 50% and 65% martensite.

* * * * *